United States Patent [19]

Spector

[11] Patent Number: 4,706,693

[45] Date of Patent: Nov. 17, 1987

[54] COSMETIC CREAM APPLICATOR

[76] Inventor: Donald Spector, 380 Mountain Rd., Union City, N.J. 07087

[21] Appl. No.: 427,193

[22] Filed: Sep. 29, 1982

[51] Int. Cl.[4] ..... A45D 40/00

[52] U.S. Cl. ..... 132/79 R

[58] Field of Search ..... 132/73, 79; 401/196; 428/305; 118/264

[56] References Cited

U.S. PATENT DOCUMENTS

| | | | |
|---|---|---|---|
| 2,902,146 | 9/1959 | Doherty | 604/1 |
| 3,228,398 | 1/1966 | Leonard et al. | 604/1 |
| 3,519,364 | 7/1970 | Truhan | 401/196 |
| 3,614,245 | 10/1971 | Schwartzman | 604/2 |
| 4,336,767 | 6/1982 | Wada | 401/196 |

*Primary Examiner*—Gregory E. McNeill

*Attorney, Agent, or Firm*—Michael Ebert

[57] ABSTRACT

A disposable applicator for a cosmetic cream which makes it possible to apply cream to the skin of the user without making finger contact with the skin, the applicator also serving to scrub and stimulate the skin surface. The applicator is constituted by a miniature sponge molded of open-pore, synthetic plastic, flexible foam material whose cells in the outer layer thereof are partially closed. Injected into the core of the sponge is a metered amount of cream which impregnates the internal pores of the sponge but is not exuded from the outer layer unless the applicator is squeezed by the user. In practice, each applicator may be packaged in a foil-type sealed envelope or a color-coded supply of applicators containing different creams may be housed in a jar.

6 Claims, 4 Drawing Figures

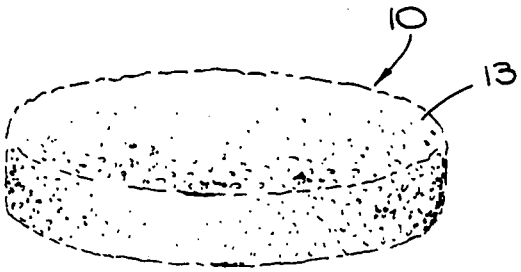
Fig. 1.
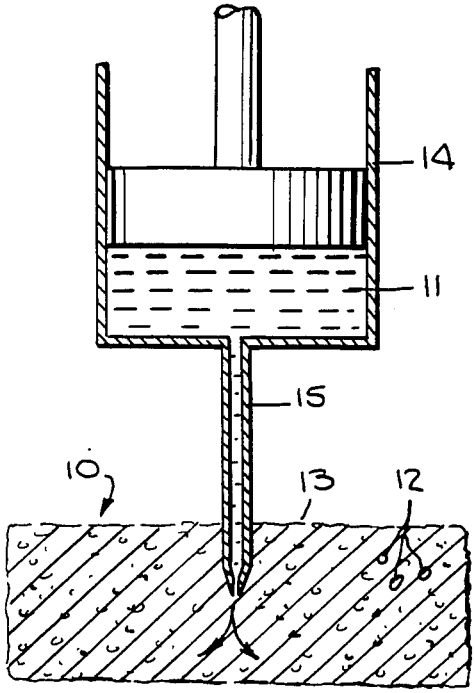
Fig. 2.
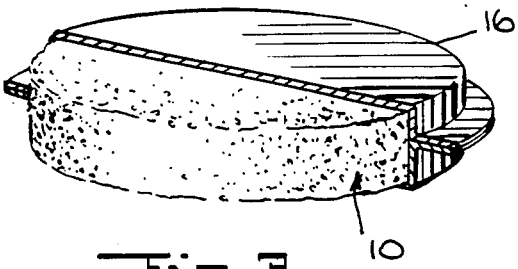
Fig. 3.
Fig. 4.
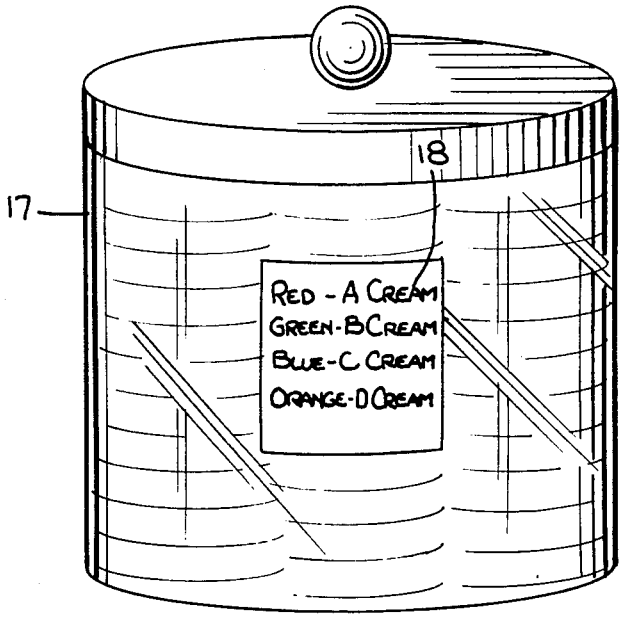

COSMETIC CREAM APPLICATOR

BACKGROUND OF INVENTION

This invention relates generally to cosmetic creams, and in particular to a disposable applicator for a cosmetic cream which stores a metered amount thereof.

The human skin or outer covering of the body is composed of two principal layers; namely, an outer layer or epidermis, and an inner layer or dermis. The epidermis consists of layers of cells that develop from the bottom up, becoming flatter in each succeeding cell layer. When they reach the surface, the cells are shed as "dead skin." The epidermis has no blood vessels, but in the deeper cell layers, there are nerves as well as pigment that imparts color to the skin. The general functions of the skin are protection, excretion, secretion and sensation. Skin is adversely affected not only by excessive exposure to the sun, resulting in skin damage and the loss of moisture, but also by atmospheric contaminants as well as by stress conditions which may discolor the skin. Aging skin is also marked by the loss of moisture.

The use of cosmetic creams to improve the condition of the skin and to enhance its beauty has a long history. The ingredients of cosmetics and their uses were first recorded in ancient Egypt whose tombs have yielded cosmetic jars. In modern times, moisturizing and cleansing creams are contained in bottles and jars with screw-on caps, or in squeeze tubes. The user generally extracts a small quantity of the cream with her fingers which she then applies to the skin, using the fingers to rub in the cream.

There are two main drawbacks to this practice. First, the user is not able with her fingers to extract the appropriate amount of cream and usually extracts from the jar more than is needed for a given application. Hence the excess cream must be wiped from the surface of the skin. This is not only wasteful of cream, but in some situations presents a further difficulty; for if the user is away from home, she may not have a tissue available for removing excess cream; and if she must use her handkerchief for this purpose, she will soil the fabric. Second, the user's fingers may not be clean and sterile, and in applying cream to her face, she may contaminate the surface thereof and thereby defeat the purpose of the cream. Moreover, women with long fingernails cannot apply moisturizers to the skin in the region around the eyes.

Another problem which arises is that the typical user generally has available in her home a number of jars containing various types of creams serving different functions, such as night, moisturizing and cleansing creams. But when traveling, it is not usually feasible to carry a full supply of such cosmetics and the user therefore is denied the benefit thereof. As a practical matter, one can only carry a jar or two of cosmetic creams in a weekend bag, even when the jars are in small sizes. Moreover, such small jars hold far more cream than is required for a weekend trip.

SUMMARY OF INVENTION

In view of the foregoing, the main object of this invention is to provide a disposable applicator which stores a metered amount of a cosmetic cream sufficient for a single application.

A significant advantage of an applicator in accordance with the invention is that it functions not only to store a given cosmetic cream, but also to apply it to the skin surface without any contact between the user's fingers and the skin, thereby avoiding contamination.

More particularly, it is an bject of this invention to provide a sponge-like, open-pore applicator which stores a metered amount of a cosmetic cream, the cream being exuded from the applicator only when pressure is applied thereto, the applicator functioning not only to apply the cream to the skin but also to scrub dead skin and dirt from the skin surface, which surface debris is picked up and retained by the applicator, thereby obviating the need for a tissue or towel.

Also an object of this invention is to provide a jar containing a substantial supply of color-coded applicators, each color indicating the nature of the stored cream, so that the user has available a full range of different creams in a single container.

Briefly stated, these objects are attained in a disposable applicator for a cosmetic cream which makes it possible to apply cream to the skin of the use without making finger contact with the skin, the applicator also serving to scrub and stimulate the skin surface. The applicator is constituted by a miniature sponge molded of open-pore, synthetic plastic, flexible foam material whose cells in the outer layer thereof are partially closed. Injected into the core of the sponge is a metered amount of cream which impregnates the internal pores of the sponge but is not exuded from the outer layer unless the applicator is squeezed by the user. In practice, each applicator may be packaged in a foil-type sealed envelope or a color-coded supply of applicators containing different creams may be housed in a jar.

OUTLINE OF DRAWINGS

For a better understanding of the invention as well as other objects and further features thereof, reference is made to the following detailed description to be read in conjunction with the accompanying drawings, wherein:

FIG. 1 is a perspective view of a cosmetic cream applicator in accordance with the invention;

FIG. 2 is a section taken through the applicator, showing cream being injected therein;

FIG. 3 shows in section a sealed foil envelope containing a single applicator; and FIG. 4 shows a jar containing a supply of color-coded applicators.

DESCRIPTION OF INVENTION

Referring now to FIGS. 1 and 2, there is shown an applicator in accordance with the invention, the applicator being constituted by a miniature sponge 10 having a metered amount of cosmetic cream 11 impregnated therein. In practice, the sponge may be in the form of a small foam plastic pad having an elliptical shape whose maximum diameter is about one and one-half inches, the thickness of the pad being about ½ inch.

A sponge pad in this size is easily manipulated by the user and has a sufficient supply of cosmetic cream for a single skin application. The sponge is fabricated by molding a synthetic plastic flexible foam material such as polyurethane or polyvinyl chloride having an open cell structure in which the cells communicate with each other.

Plastic foams are made from a wide variety of polymers. For the manufacture of polyurethane foam, compounds containing hydroxyl groups of high molecular weight are mixed with isocyanates and water. Surplus isocyanate groups react with the added water and the carbon dioxide which is evolved acts as the foaming agent.

In the present invention, the reaction mixture is cast in a small mold having a shape of the elliptical pad shown in FIG. 1, foaming taking place in the mold. Because of the foaming and expansion of the plastic in the mold, pressure is exerted on the confining wall of the mold which defines the outer layer of the pad and which acts to partially close the pores in this layer.

Thus the flexible foam plastic pad 10, as shown in FIG. 2, has relatively large internal pores 12 and an outer layer 13 or skin in which the pores are partially closed.

A predetermined amount of cosmetic cream 11 is containined in an injection syringe 14 or similar cream dispenser having a hollow needle 15, the cream being injected into the core of the pad to impregnate the internal pores thereof. But because the pores in the outer layer 13 are partially closed, this reduces volatilization loss from the sponge, even if it is exposed to the atmosphere for a prolohged period. In mass production practice, the syringe may take the form of a cylinder having a retractable ram in which a metered amount of cream is fed after each ram action.

When the sponge pad is held by the user and applied to the skin surface, the pad is then squeezed to cause the cream to be exuded therefrom. The relatively coarse pad serves not only to apply cream to the skin surface but is also usable to scrub this surface of dead skin or other debris. This debris is picked up and retained by the pad which is discarded after a single use.

Where the applicator is intended to apply moisturizing cream to the face of the user, a miniature pad of the dimensions described has an adequate supply of cream for this purpose, and no more than is necessary. Where, however, one wishes to provide an applicator to apply cream to the entire body of the user, the pad may be made in much larger sizes to contain an adequate supply of cream for this purpose and also to afford a larger scrubbing area.

A single applicator 10 may, shown in FIG. 3, be packaged in a tear-type sealed metal foil-plastic laminate envelope 16, so that no cream is permitted to escape until the applicator is put to use. A user may carry several such envelopes in her handbag.

In practice, the pads may be color coded to indicate the nature of the cream content, so that the user may store many such color-coded pads in a jar 17, as shown in FIG. 4. The jar may carry a label 18 relating the type of the cream contained in the pads to a listing of colors. Thus a red pad may combine a night cream, a green pad a moisturizing cream and a yellow pad a cleansing cream.

While there has been shown and described a preferred embodiment of a cosmetic cream applicator in accordance with the invention, it will be appreciated that many changes and modifications may be made therein without, however, departing from the essential spirit thereof. Thus in practice, instead of molding the sponge, a black foam plastic material may be die cut by a heated die in a manner whereby the outer pores of the pad cut off from the block are partially closed.

I claim:

1. A disposable applicator for a skin moisturizer cosmetic cream which makes it possible to apply the cream to the skin of the user without finger contact with the skin, and to scrub the skin surface, said applicator comprising a relatively rough pad formed of flexible foam synthetic plastic material having open cells, the outer layer of the pad having partially closed pores, said pad having injected therein a metered amount of the cosmetic cream which impregnates the internal pores thereof but is not exuded from the outer layer unless the applicator is squeezed by the user, said outer layer reducing volatilization of the skin moisturizer cream from the pad during storage of the applicator.

2. An applicator as set forth in claim 1, wherein said pad is formed of polyurethane foam material.

3. An applicator as set forth in claim 1, wherein said pad has an elliptical shape, a maximum diameter of which is less that two inches, the thickness of which is less than one inch.

4. An applicator as set forth in claim 1, wherein said foam plastic material includes a dye to impart a distinctive color to the pad which is related to the nature of the cream, whereby applicators of different colors have different creams therein.

5. An applicator as set forth in claim 1, housed within a sealed metal foil envelope.

6. A jar containing a plurality of applicators of the type set forth in claim 1, whereby a user has available in the jar a choice of different creams.

* * * * *